US008404418B2

(12) United States Patent
Kunii et al.

(10) Patent No.: US 8,404,418 B2
(45) Date of Patent: Mar. 26, 2013

(54) TONER FOR ELECTROSTATIC IMAGE DEVELOPMENT

(75) Inventors: Satoshi Kunii, Wakayama (JP); Masahito Yamazaki, Wakayama (JP)

(73) Assignee: Kao Corporation, Tokyo (JP)

( * ) Notice: Subject to any disclaimer, the term of this patent is extended or adjusted under 35 U.S.C. 154(b) by 671 days.

(21) Appl. No.: 12/559,064

(22) Filed: Sep. 14, 2009

(65) Prior Publication Data

US 2010/0075242 A1 Mar. 25, 2010

(30) Foreign Application Priority Data

Sep. 22, 2008 (JP) ..... 2008-242855

(51) Int. Cl.
*G03G 9/08* (2006.01)

(52) U.S. Cl. ..... 430/108.6; 430/108.7; 430/109.4

(58) Field of Classification Search ..... 430/108.6, 430/109.4, 108.7
See application file for complete search history.

(56) References Cited

U.S. PATENT DOCUMENTS

| | | | | |
|---|---|---|---|---|
| 6,777,152 | B2 | 8/2004 | Konya et al. | |
| 6,861,190 | B2 | 3/2005 | Yamazaki et al. | |
| 2003/0044706 | A1* | 3/2003 | Konya et al. | 430/108.6 |
| 2003/0059700 | A1* | 3/2003 | Konya et al. | 430/108.6 |
| 2003/0104299 | A1* | 6/2003 | Sata et al. | 430/108.6 |
| 2003/0190543 | A1* | 10/2003 | Sugiura et al. | 430/108.6 |
| 2004/0067189 | A1* | 4/2004 | Sugiura et al. | 423/335 |
| 2004/0197692 | A1 | 10/2004 | Yamane et al. | |
| 2005/0233236 | A1* | 10/2005 | Eida et al. | 430/108.7 |
| 2006/0167214 | A1 | 7/2006 | Terauchi et al. | |
| 2006/0222992 | A1* | 10/2006 | Kamoto | 430/109.4 |
| 2007/0020550 | A1* | 1/2007 | Kamoto | 430/109.4 |
| 2007/0212633 | A1* | 9/2007 | Yamagami | 430/137.14 |
| 2008/0063964 | A1* | 3/2008 | Tomita | 430/105 |
| 2008/0268365 | A1 | 10/2008 | Yamazaki et al. | |
| 2009/0075195 | A1* | 3/2009 | Shu et al. | 430/109.4 |
| 2009/0239171 | A1 | 9/2009 | Anno et al. | |
| 2009/0280426 | A1 | 11/2009 | Kunii et al. | |
| 2009/0280427 | A1 | 11/2009 | Kunii et al. | |

FOREIGN PATENT DOCUMENTS

| | | |
|---|---|---|
| JP | 63-075755 | 4/1988 |
| JP | 7-271083 | 10/1995 |
| JP | 2001-51448 | 2/2001 |
| JP | 2003-76058 | 3/2003 |
| JP | 2003-322998 | 11/2003 |
| JP | 2004-143028 | 5/2004 |
| JP | 2004-233407 | 8/2004 |
| JP | 2004-258627 | 9/2004 |
| JP | 2004-302030 | 10/2004 |
| JP | 2005-49511 | 2/2005 |
| JP | 2005-165089 | 6/2005 |
| JP | 2005-292592 | 10/2005 |
| JP | 2005-352081 | 12/2005 |
| JP | 2006-38954 | 2/2006 |
| JP | 2007-249166 | 9/2007 |
| JP | 2008-073007 | 3/2008 |
| JP | 2008-122931 | 5/2008 |
| JP | 2008-145490 | 6/2008 |
| JP | 2009-258681 | 11/2009 |

OTHER PUBLICATIONS

U.S. Appl. No. 13/309,731, filed Dec. 2, 2011, Yamazaki, et al.
U.S. Appl. No. 12/689,531, filed Jan. 19, 2010, Kunii, et al.
Japanese Notification of Submission of Observations by Third Party on Documents and the like issued Dec. 7, 2011 in patent application No. 2008-242855 with English translation.
Office Action issued Jan. 4, 2013, in Japanese Patent Application No. 2008-242855 filed Sep. 22, 2008 (with English translation).

* cited by examiner

*Primary Examiner* — Hoa V Le
(74) *Attorney, Agent, or Firm* — Oblon, Spivak, McClelland, Maier & Neustadt, L.L.P.

(57) ABSTRACT

A toner for electrostatic image development containing (a) a toner matrix particle containing a resin binder, and (b) an external additive added to the toner matrix particles, wherein the resin binder contains a polyester A obtained by polycondensing an alcohol component and a carboxylic acid component containing isophthalic acid and/or an ester thereof, and wherein the external additive contains fine silica particles containing a metal or a metal oxide; and A method of forming fixed images including the step of applying the toner for electrostatic image development to an image-forming apparatus according to a non-contact fusing method. The toner for electrostatic image development of the present invention is suitably used in developing latent images formed in, for example, electrophotography, an electrostatic recording method, an electrostatic printing method, or the like.

20 Claims, No Drawings

TONER FOR ELECTROSTATIC IMAGE DEVELOPMENT

FIELD OF THE INVENTION

The present invention relates to a toner for electrostatic image development usable in developing latent images formed in, for example, electrophotography, an electrostatic recording method, an electrostatic printing method, or the like, and a method of forming fixed images using the toner.

BACKGROUND OF THE INVENTION

With the growth of print-on-demand market in the recent years, the demands for speeding up for electrophotographic technique are ever more increasing. Therefore, a polyester having a low softening point is widely used in order to fix a toner at low temperatures. However, mere use of a polyester having a low softening point leads to some disadvantages such as lowered durability and fusion of a toner to a member of the machine.

In view of the above, for example, JP-A-2001-51448 discloses a technique of a toner for electrostatic image development, in which a polyester resin containing isophthalic acid and an isophthalic acid derivative in an amount of from 25 to 50% by mol is used, whereby the resulting toner has excellent low-temperature fixing properties, is free from the generation of fusion to a developing roller or a blade, toner dust, background fogging, and the like, during a long-term continuous copying, and can realize stable image properties.

In addition, in high-speed continuous printing, the stress against the toner is strong, so that an external additive is likely to be embedded. If the fluidity is lowered due to the embedment of the external additive, the toner is disadvantageous in developability or transferability, in other words, more disadvantageous in durability, which in turn would cause the lowering of the image quality. In view of the above, JP-A-2005-352081 discloses a technique of a toner for electrostatic image development containing a negatively chargeable charge control agent and a positively chargeable charge control agent, and large-particle size fine inorganic particles having a BET specific surface area of from 20 to 30 $m^2/g$ as an external additive, thereby suppressing the external additive from being embedded, so that excellent fluidity is maintained.

SUMMARY OF THE INVENTION

The present invention relates to:

[1] a toner for electrostatic image development containing (a) a toner matrix particle containing a resin binder, and (b) an external additive added to the toner matrix particle, wherein the resin binder contains a polyester A obtained by polycondensing an alcohol component and a carboxylic acid component containing isophthalic acid and/or an ester thereof, and wherein the external additive contains fine silica particles containing a metal or a metal oxide; and

[2] a method of forming fixed images including the step of applying the toner as defined above to an image-forming apparatus according to a non-contact fusing method.

DETAILED DESCRIPTION OF THE INVENTION

Raw material monomers of isophthalic acid compounds are highly reactive, so that the resulting resins are likely to contain smaller amounts of low-molecular weight components, thereby lowering their acid values, which in turn are likely to cause "charge-up phenomenon" in the triboelectric properties. In particular, in a high-speed machine, the charge-up phenomenon more prominently takes place due to a strong agitation stress, so that the electrostatic adhesion of a toner to a member in the machine becomes very strong, thereby making it disadvantageous in developability, which in turn leads to the lowering of the image quality.

The present invention relates to a toner for electrostatic image development, having excellent durability and triboelectric chargeability even in a high-speed machine, thereby making it possible to form stable fixed images for a long period of time, and a method of forming fixed images using the toner.

The toner for electrostatic image development of the present invention exhibits excellent effects that the toner has excellent durability and triboelectric chargeability even in a high-speed machine, thereby making it possible to form stable fixed images for a long period of time.

These and other advantages of the present invention will be apparent from the following description.

The toner for electrostatic image development of the present invention contains a toner matrix particle containing a specified resin binder, and a specified external additive added to the toner matrix particle. Specifically, a great feature of the toner for electrostatic image development of the present invention resides in that the resin binder contains a polyester obtained by polycondensing a carboxylic acid component containing isophthalic acid and/or an ester thereof (which may be hereinafter also referred to as "isophthalic acid compound") and an alcohol component, and that the external additive contains fine silica particles containing a metal or a metal oxide. It has been found that the uniformness in the triboelectric charges among the toners is improved when a polyester-constituting unit containing an isophthalic acid compound is used together with an external additive containing fine silica particles containing a metal or a metal oxide. Although not wanted to be limited by theory, the reasons why the uniformness of the triboelectric charges is improved is presumably as follows. The above-mentioned silica shows improvement in electroconductivity by the metal, as compared to that of a silica without containing a metal or metal oxide, so that the triboelectric charges among the toners are likely to be uniform.

The isophthalic acid compound is contained as a polyester-constituting unit in the polyester A in an amount of preferably from 50 to 100% by mol, more preferably from 70 to 100% by mol, and even more preferably from 90 to 100% by mol, of the carboxylic acid component, from the viewpoint of improving durability of the toner and from the viewpoint of reducing the proportion of the wrong sign toner.

The polyester A is contained in an amount of preferably from 50 to 100% by weight, more preferably from 60 to 90% by weight, and even more preferably from 60 to 80% by weight, of the resin binder, from the viewpoint of improving durability of the toner and from the viewpoint of reducing the proportion of the wrong sign toner.

In the present invention, from the viewpoint of improving low-temperature fixing ability as compared to the case where only an aromatic carboxylic compound such as isophthalic acid is used as a carboxylic acid component of the polyester, it is preferable that one or more members selected from the group consisting of fumaric acid, maleic acid, maleic anhydride, and an ester thereof (which may be hereinafter referred to as a "fumaric acid/maleic acid compound") are further used as the carboxylic acid component of the polyester. The esters of isophthalic acid, fumaric acid and maleic acid include lower alkyl (1 to 6 carbon atoms) esters thereof, and the like.

The fumaric acid/maleic acid compound may be used as a carboxylic acid component of a polyester different from the polyester obtained by using a carboxylic acid component containing the isophthalic acid compound (a first embodiment), or the fumaric acid/maleic acid compound may be used as a carboxylic acid component of the same polyester together with the isophthalic compound (a second embodiment), and the first embodiment is preferable, from the viewpoint of improving durability of the toner.

The first embodiment of the polyester in the present invention contains a polyester A obtained by polycondensing a carboxylic acid component containing an isophthalic acid compound, and an alcohol component, and a polyester B obtained by polycondensing a carboxylic acid component containing a fumaric acid/maleic acid compound, and an alcohol component.

In addition, the fumaric acid/maleic acid compound in the polyester B is contained in an amount of preferably 50% by mol or more, more preferably 70% by mol or more, and even more preferably 90% by mol or more, of the carboxylic acid component, from the viewpoint of improving low-temperature fixing ability and transfer efficiency of the toner. Here, the isophthalic acid compound is preferably not contained in the carboxylic acid component of the polyester B. If contained, it is preferable that the isophthalic acid compound is contained in an amount of 5% by mol or less, of the carboxylic acid component. In addition, it is preferable that the fumaric acid/maleic acid compound is not contained in the carboxylic acid component of the polyester A, in a case where the polyester A is used together with the polyester B. If contained, it is preferable that the fumaric acid/maleic acid compound is contained in an amount of 5% by mol or less of the carboxylic acid component.

Here, in the first embodiment, the polyester A has an acid value of preferably less than 6 mg KOH/g, and more preferably less than 4 mg KOH/g, from the viewpoint of maintaining stable triboelectric chargeability even under various environmental conditions such as high temperatures and high humidity.

The polyester A and the polyester B in the resin binder are preferably in a weight ratio, i.e. the polyester A/the polyester B, of preferably from 50/50 to 90/10, and more preferably from 60/40 to 80/20, from the viewpoint of the low-temperature fixing ability, triboelectric chargeability, and image density.

A second embodiment of the polyester in the present invention is an embodiment in which the carboxylic acid component of the polyester A further contains a fumaric acid/maleic acid compound, in other words, the polyester A contains a polyester C obtained by polycondensing a carboxylic acid component containing an isophthalic acid compound and a fumaric acid/maleic acid compound, and an alcohol component.

The isophthalic acid compound is contained as a polyester-constituting unit in the polyester C in an amount of preferably from 30 to 80% by mol, more preferably from 40 to 70% by mol, and even more preferably from 50 to 60% by mol, of the carboxylic acid component, from the viewpoint of improving durability and low-temperature fixing ability of the toner.

In addition, the fumaric acid/maleic acid compound is contained as a polyester-constituting unit in the polyester C in an amount of preferably from 20 to 70 mol, more preferably from 30 to 60 mol, and even more preferably from 40 to 50 mol, based on 100 mol of the isophthalic acid compound, from the viewpoint of improving durability and low-temperature fixing ability of the toner.

In the first and the second embodiments, the alcohol component of the polyester includes an alkylene oxide adduct of bisphenol A represented by the formula (I):

(I)

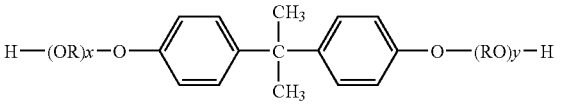

wherein each of RO and OR is an oxyalkylene group, wherein R is an ethylene group and/or a propylene group; x and y are number of moles of alkylene oxides added, each being a positive number, wherein an average of the sum of x and y is preferably from 1 to 16, more preferably from 1 to 8, and even more preferably from 1.5 to 4;

ethylene glycol, propylene glycol, glycerol, pentaerythritol, trimethylolpropane, hydrogenated bisphenol A, sorbitol, or alkylene (2 to 4 carbon atoms) oxide (number of moles in average: 1 to 16) adducts thereof; and the like.

Among them, the alkylene oxide adduct of bisphenol A represented by the formula (I) is preferred, from the viewpoint of durability and triboelectric chargeability of the toner.

The alkylene oxide adduct of bisphenol A represented by the formula (I) is contained in an amount of preferably 5% by mol or more, more preferably 50% by mol or more, and even more preferably substantially 100% by mol, of the alcohol component.

On the other hand, the carboxylic acid component other than the isophthalic acid compound and the fumaric acid/maleic acid compound includes dicarboxylic acids such as phthalic acid, terephthalic acid, adipic acid, and succinic acid; succinic acids substituted with an alkyl group having 1 to 20 carbon atoms or an alkenyl group having 2 to 20 carbon atoms, such as dodecenylsuccinic acid and octenylsuccinic acid; tricarboxylic or higher polycarboxylic acids such as trimellitic acid and pyromellitic acid; acid anhydrides thereof and alkyl (1 to 8 carbon atoms) esters of these acids; and the like.

In addition, the alcohol component may properly contain a monohydric alcohol, and the carboxylic acid component may properly contain a monocarboxylic acid compound, from the viewpoint of adjusting its molecular weight, and the like.

In the present invention, it is preferable that all of the polyesters A to C are linear polyesters, from the viewpoint of low-temperature fixing ability. The linear polyester refers to a polyester containing a trivalent or higher polyvalent monomer, i.e. a trihydric or polyhydric alcohol and/or a tricarboxylic or higher polycarboxylic acid compound, in an amount of less than 1% by mol of a total amount of the carboxylic acid component and the alcohol component, and it is preferred that the trivalent or higher polyvalent monomer is not substantially contained. On the other hand, a nonlinear polyester refers to a polyester containing a trivalent or higher polyvalent monomer in an amount of 1% by mol or more of a total amount of the carboxylic acid component and the alcohol component. It is preferable that the resin binder of the toner of the present invention does not contain a nonlinear polyester, from the viewpoint of improving the low-temperature fixing ability of the toner.

The polyester is obtained by, for example, polycondensing an alcohol component and a carboxylic acid component in an inert gas atmosphere at a temperature of 180° to 250° C., in the presence of an esterification catalyst, a polymerization inhibitor, as occasion demands.

The polyester has a softening point of preferably from 90° to 120° C., more preferably from 95° to 115° C., and even more preferably from 100° to 110° C., from the viewpoint of low-temperature fixing ability and durability of the toner.

The polyester has a glass transition temperature of preferably from 50° to 85° C., and more preferably from 55° to 80° C., from the viewpoint of storage property and low-temperature fixing ability of the toner.

In both the softening point and the glass transition temperature, in a case where the polyester contains plural polyesters as in the first embodiment mentioned above, it is preferable that a weighed average efficiency thereof is within the above-mentioned range.

Here, in the present invention, the polyester may be a modified polyester to an extent that its properties are not substantially impaired. The modified polyester refers to a grafted or blocked polyester with phenol, urethane, epoxy, or the like, in accordance with the methods described in, for example, JP-A-Hei-11-133668, JP-A-Hei-10-239903, JP-A-Hei-8-20636, and the like.

In the present invention, a resin binder may properly contain a polyester other than the above-mentioned polyesters and other resin binders to an extent that the effects of the present invention would not be impaired. The above-mentioned polyester is contained in an amount of preferably from 70 to 100% by weight, and more preferably substantially 100% by weight, of the resin binder. Other resin binders include vinyl resins, epoxy resins, polycarbonates, polyurethanes, and the like.

The toner matrix particle may contain, besides the resin binder, an additive such as a colorant, a charge control agent, a releasing agent, an electric conductivity modifier, an extender, a reinforcing filler such as a fibrous substance, an antioxidant, or an anti-aging agent.

As the colorant, all of dyes, pigments, and the like which are used as colorants for a toner can be used. The colorant includes carbon blacks, black pigments, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazoyellow, and the like. These colorants can be contained alone or in a mixture of two or more kinds. The toner of the present invention may be any of black toners and color toners. The colorant is contained in an amount of preferably from 1 to 40 parts by weight, and more preferably from 3 to 10 parts by weight, based on 100 parts by weight of the resin binder.

As the charge control agent, any one of negatively chargeable and positively chargeable charge control agents can be used. The negatively chargeable charge control agent includes, for example, metal-containing azo dyes, copper phthalocyanine dyes, metal complexes of alkyl derivatives of salicylic acid, nitroimidazole derivatives, polymers of phenols and aldehydes, such as calixarene, and the like. The positively chargeable charge control agent includes, for example, Nigrosine dyes, triphenylmethane-based dyes, quaternary ammonium salt compounds, polyamine resins, imidazole derivatives and the like. These charge control agents can be contained alone or in a mixture of two or more kinds. In addition, a polymeric charge control agent such as a resin can be used. The charge control agent is contained in an amount of preferably from 0.1 to 8 parts by weight, and more preferably from 0.2 to 5 parts by weight, based on 100 parts by weight of the resin binder.

The releasing agent includes aliphatic hydrocarbon waxes such as low-molecular weight polypropylenes, low-molecular weight polyethylenes, low-molecular weight polypropylene-polyethylene copolymers, microcrystalline waxes, paraffinic waxes, and Fischer-Tropsch wax, and oxides thereof; ester waxes such as carnauba wax, montan wax, and sazole wax, and deacidified waxes thereof; fatty acid amides, fatty acids, higher alcohols, metal salts of fatty acids, and the like. These waxes can be contained alone or in a mixture of two or more kinds. The releasing agent is contained in an amount of preferably from 1 to 20 parts by weight, and more preferably from 2 to 10 parts by weight, based on 100 parts by weight of the resin binder. The releasing agent has a melting point of preferably from 60° to 120° C., more preferably from 70° to 100° C., and even more preferably from 70° to 90° C., from the viewpoint of fixing ability of the toner.

The method for producing a toner matrix particle may be any of known methods such as a kneading-pulverization method, an emulsion phase-inversion method, and a polymerization method, and the kneading-pulverization method is preferred because the production is facilitated. For example, in the case of a pulverized toner produced by the kneading-pulverization method, a toner can be produced by homogeneously mixing a resin binder, a colorant, a charge control agent, a releasing agent, and the like with a mixer such as a Henschel mixer, thereafter melt-kneading the mixture with a closed kneader, a single-screw or twin-screw extruder, open-roller type kneader, or the like, cooling, pulverizing, and classifying the product. The silica containing at least a metal or a metal oxide is added as an external additive to the resulting toner matrix particle, as mentioned above, thereby giving the toner of the present invention. The fine silica particles containing a metal or a metal oxide (hereinafter also referred to as "metal-containing silica") is preferably fine silica particles containing at least one metal or metal oxide selected from the group consisting of titanium, aluminum, tin and oxides thereof, more preferably fine silica particles containing titanium, aluminum or an oxide thereof, even more preferably fine silica particles containing titanium oxide, from the viewpoint of reducing the proportion of the wrong sign toner, from the viewpoint of improving transfer efficiency of the toner, and from the viewpoint of improving image density.

The metal-containing silica is preferably a complex oxide containing silica obtained by spray combustion of raw materials containing a siloxane and an organometallic compound containing one or more metals other than silicon, from the viewpoint of neutralizing strong triboelectric charges of the toner, thereby stabilizing developability of the toner.

The siloxane used herein (i.e., meaning an organo(poly) siloxane compound, hereinafter referred to the same) includes a linear organopolysiloxane without containing any halogens, represented by the formula (II):

$$(R^1)_3SiO[SiR^2R^3O]_mSi(R^4)_3 \quad \text{(II)}$$

wherein each of $R^1$, $R^2$, $R^3$ and $R^4$, which may be identical to or different from each other, is a monovalent hydrocarbon group, an alkoxy group or a hydrogen atom; and m is an integer of 0 or greater, a cyclic organopolysiloxane represented by the formula (III):

$$[SiR^2R^3O]_n \quad \text{(III)}$$

wherein $R^2$ and $R^3$ are as defined above; and n is an integer of 3 or greater, an organopolysiloxane in a branched form, a linear form with partially branching, a three-dimensional network form, or the like, represented by the formula (IV):

$$[SiR^6O_{3/2}]_p[SiO_2]_q[SiR^7R^8O]_r[Si(R^5)_3O_{1/2}]_s \quad \text{(IV)}$$

wherein each of $R^5$, $R^6$, $R^7$ and $R^8$, which may be identical to or different from each other, is a monovalent hydrocarbon group, an alkoxy group or a hydrogen atom; and p, q, r and s are integers of 0 or greater, or mixtures thereof, and the like.

In the formulae (II) to (IV), the monovalent hydrocarbon groups $R^1$ to $R^8$ have preferably from 1 to 10 carbon atoms, and more preferably from 1 to 8 carbon atoms. Specific examples of the hydrocarbon group includes alkyl groups such as a methyl group, an ethyl group, a propyl group, an isopropyl group, a butyl group, an isobutyl group, a tert-butyl group, a pentyl group, a hexyl group and a cyclohexyl group; alkenyl groups such as a vinyl group, an allyl group, a propenyl group, a butenyl group and a hexenyl group; aryl groups such as a phenyl group; aralkyl groups such as a benzyl group; and the like. Among them, lower alkyl groups having 1 to 3 carbon atoms, such as a methyl group, an ethyl group and a propyl group, are preferable, and a methyl group is more preferable. Also, the alkoxy group is preferably an alkoxy group having 1 to 6 carbon atoms, such as a methoxy group or an ethoxy group, and more preferably a methoxy group.

Here, m, p, q, r and s are integers of 0 or greater, and preferably an integer of from 0 to 100. In addition, n is an integer of 3 or greater, and preferably an integer of from 3 to 7. Further, m is preferably an integer of from 0 to 80. The sum of p, q, r and s is preferably from 3 to 80, and more preferably from 4 to 50.

The above siloxane includes, for example, hexamethyldisiloxane, octamethyltrisiloxane, octamethylcyclotetrasiloxane, decamethylcyclopentasiloxane, and the like. These siloxanes are preferably siloxanes which are obtained after purification, without containing a halogen such as chlorine, and the resulting siloxanes have high purity without substantially containing impurities such as a metal. Therefore, the siloxanes are suitable as raw materials for the complex oxide containing silica.

The organometallic compound containing one or more metals other than silicon is preferably a metal alkoxide compound, a metal acylate compound, a organometallic acid compound, a metal alkyl compound, a metal chelate compound, or the like. The metal is preferably titanium, alumina, or the like, as mentioned above.

The spray combustion of the raw materials can be carried out, for instance, by simultaneously spraying the siloxane and the organometallic compound containing one or more metals other than silicon, and subjecting the mixture to an oxidative combustion in the flame.

In order to allow the complete oxidative combustion of the organometallic compound and uniform combustion of the raw materials containing siloxane in a complex form, it is preferable that the organometallic compound is used in a liquid form so that the compound can be finely sprayed. When the organometallic compound is subjected to combustion in a solid powdery form, the variance in the compositions of the formed fine particles is generated due to their unevenness in combustion points, and at the same time the combustion would be incomplete, thereby resulting in the undesired residuality of carbon in a larger amount. For this reason, it is preferable that the organometallic compound in a liquid state at room temperature (for example, from 5° to 35° C.) is used directly as it is, or that the organometallic compound in a solid form at room temperature is dissolved in an alcohol or a hydrocarbon-based solvent to be used in a liquid form (i.e., in a solution state), to be simultaneously sprayed with the siloxane. Here, the siloxane includes those used for the raw materials exemplified above, such as linear siloxanes and cyclic siloxanes, such as hexamethyldisiloxane and octamethylcyclotetrasiloxane, and the like; the alcohol includes methanol, ethanol, n-propyl alcohol, isopropyl alcohol, n-butyl alcohol, isobutyl alcohol, sec-butyl alcohol, tert-butyl alcohol, and the like; the hydrocarbon-based solvent includes hexane, cyclohexane, benzene, toluene, xylene, ethylbenzene, diethylbenzene, kerosene, and the like.

The droplets of the siloxane and the organometallic compound sprayed are exposed to heat by auxiliary flame of an oxidizing gas and the combustion flame, and subjected to an oxidative combustion while evaporating or thermally decomposing the droplets, so that silica is generated from the siloxane and a metal oxide is generated from the organometallic compound concurrently in the vapor phase, and fusing the formed compounds, whereby consequently obtaining a complex oxide containing silica, that is usually in an amorphous state, in which the silica and the metal oxide other than silica are homogeneously dispersed to form a complex oxide.

The silica and the metal compound in the complex oxide containing silica are preferably in a weight ratio, i.e. the silica/the metal compound, of preferably from 10/90 to 99/1, and the silica and the metal compound are in a weight ratio of more preferably from 50/50 to 99/1, and even more preferably from 80/20 to 99/1, from the viewpoint of triboelectric stability of the toner and reduction of detachment of silica from toner.

The metal-containing silica has a number-average particle size of preferably from 100 to 1000 nm, more preferably from 150 to 700 nm, and even more preferably from 200 to 400 nm, from the viewpoint of controlling the embedment of silica into a toner and preventing the detachment of silica from a toner.

The metal-containing silica is contained in an amount of preferably from 0.1 to 5 parts by weight, more preferably from 0.1 to 1 part by weight, even more preferably from 0.2 to 0.8 parts by weight, and even more preferably from 0.2 to 0.6 parts by weight, based on 100 parts by weight of the toner matrix particles, from the viewpoint of reducing the proportion of the wrong sign toner, from the viewpoint of improving transfer efficiency of the toner, and from the viewpoint of improving image density.

Further, in the present invention, it is preferable that a so-called "small-particle size silica," which is a silica of which number-average particle size is smaller than that of the metal-containing silica, the silica containing no metal or metal oxide, is contained as an external additive, in addition to the above-mentioned metal-containing silica, from the viewpoint of fluidity of the toner.

The small-particle size silica has a number-average particle size of preferably from 5 to 100 nm, and more preferably from 10 to 50 nm.

The small-particle size silica is preferably a hydrophobic silica subjected to a hydrophobic treatment, from the viewpoint of environmental stability. The method for hydrophobic treatment is not particularly limited, and an agent for the hydrophobic treatment includes hexamethyldisilazane (HMDS), dimethyldichlorosilane (DMDS), a silicone oil, methyl triethoxysilane, and the like.

The small-particle size silica is contained in an amount of preferably from 0.1 to 10 parts by weight, and more preferably from 0.2 to 5 parts by weight, based on 100 parts by weight of the toner matrix particles.

The small-particle size silica and the metal-containing silica are preferably in a weight ratio, i.e. the small-particle size silica/the metal-containing silica, of preferably from 10/1 to 10/9, and more preferably from 10/2 to 10/7, from the viewpoint of improving fluidity and transferability of the toner.

The toner of the present invention may contain as an external additive fine inorganic particles other than the metal-containing silica and the small-particle size silica mentioned above, such as those of alumina, titania, zirconia, tin oxide, zinc oxide, and the like, and fine organic particles such as fine resin particles. It is preferable that these particles have a particle size smaller than that of the metal-containing silica. The metal-containing silica and the small-particle size silica are contained in a total amount of preferably 50% by weight or more, more preferably 70% by weight or more, and even more preferably 90% by weight or more, of the external additive.

A mixer to be used upon mixing the toner matrix particle and the external additive is preferably a high-speed agitator such as a Henschel mixer or a Super Mixer, or an agitator used in dry blending, such as a V-type blender. The external additive may be previously mixed and added in a high-speed agitator or a V-type blender, or the external additives may be separately added.

The toner has a volume-median particle size ($D_{50}$) of preferably from 3 to 15 μm, and more preferably from 4 to 10 μm. The term "volume-median particle size ($D_{50}$)" as used herein means a particle size of which cumulative volume frequency calculated in the volume percentage accounts for 50% calculated from a smaller particle size.

The toner of the present invention can be used as a toner for monocomponent development, or mixed with a carrier to prepare a two-component developer.

The toner of the present invention is also suitably used in a method of forming fixed images used for an apparatus for forming fixed images according to a non-contact fusing system, since the toner has a low viscosity when it is melted. The non-contact fusing system includes fixing devices according to flash fusing, oven fusing, belt nip fusing, and the like. Since the toner of the present invention has a low viscosity upon melting and has excellent fixing ability even without applying a pressure, the toner is especially suitably used in an oven fusing system.

According to the method of forming fixed images of the present invention, fixed images can be formed through known steps except that the method of the present invention has a feature in the step of fixing a transferred toner image (fixing step). The steps other than the fixing step include, for example, the steps of forming an electrostatic latent image on the surface of the photoconductor (charging and exposing step); developing the electrostatic latent image (developing step); transferring the developed toner image to an image-bearing material such as paper (transferring step); removing the toner remaining in a developing member such as a photoconductive drum (cleaning step); and the like. Since the toner of the present invention contains a smaller amount of a wrong sign toner, the toner can be also suitably used in an apparatus for forming fixed images according to a non-contact development in which the developing step is more likely to be influenced by the state of the triboelectric charges of the toner. Therefore, the toner of the present invention is even more suitably used in an apparatus for forming fixed images according to a non-contact development and the above-mentioned non-contact fusing system. In addition, the toner of the present invention can maintain excellent durability and triboelectric stability, even when the toner is used in an apparatus for forming fixed images having a linear speed of from 800 mm/sec or more, and preferably from 800 to 2,000 mm/sec.

EXAMPLES

The following examples further describe and demonstrate embodiments of the present invention. The examples are given solely for the purposes of illustration and are not to be construed as limitations of the present invention.

[Softening Points of Resins]

The softening point refers to a temperature at which half of the sample flows out, when plotting a downward movement of a plunger of a flow tester (commercially available from Shimadzu Corporation, CAPILLARY RHEOMETER "CFT-500D"), against temperature, in which a sample is prepared by applying a load of 1.96 MPa thereto with the plunger and extruding a 1 g sample through a nozzle having a die pore size of 1 mm and a length of 1 mm, while heating the sample so as to raise the temperature at a rate of 6° C./min.

[Glass Transition Temperatures of Resins]

The glass transition temperature refers to a temperature of an intersection of the extension of the baseline of equal to or lower than the temperature of the maximum endothermic peak and the tangential line showing the maximum inclination between the kick-off of the peak and the top of the peak, which is determined using a differential scanning calorimeter ("DSC 210," commercially available from Seiko Instruments, Inc.), by raising its temperature to 160° C., cooling the sample from this temperature to 0° C. at a cooling rate of 10° C./min, and thereafter raising the temperature of the sample at a heating rate of 10° C./min.

[Acid Values of Resins]

The acid values are measured as prescribed by a method of JIS K0070, provided that only a measurement solvent is changed from a mixed solvent of ethanol and ether as prescribed in JIS K0070 to a mixed solvent of acetone and toluene (acetone:toluene=1:1 (volume ratio)).

[Melting Point of Releasing Agents]

A temperature of maximum endothermic peak of the heat of fusion obtained by raising the temperature of a sample to 200° C. using a differential scanning calorimeter ("DSC 210," commercially available from Seiko Instruments, Inc.), cooling the sample from this temperature to 0° C. at a cooling rate of 10° C./min, and thereafter raising the temperature of the sample at a heating rate of 10° C./min, is referred to as a melting point.

[Volume-Median Particle Size ($D_{50}$) of Toners]

Measuring Apparatus: Coulter Multisizer II (commercially available from Beckman Coulter, Inc.)

Aperture Diameter: 50 μm

Analyzing Software: Coulter Multisizer AccuComp Ver. 1.19 (commercially available from Beckman Coulter, Inc.)

Electrolytic Solution: "Isotone II" (commercially available from Beckman Coulter, Inc.)

Dispersion: Electrolytic Solution having a concentration of 5% by weight of "EMULGEN 109P" (commercially available from Kao Corporation, polyoxyethylene lauryl ether, HLB: 13.6)

Dispersion Conditions: Ten milligrams of a measurement sample is added to 5 ml of the above dispersion, and the mixture is dispersed for 1 minute with an ultrasonic disperser, and 25 ml of an electrolytic solution is added to the dispersion, and further dispersed with an ultrasonic disperser for 1 minute, to prepare a sample dispersion.

Measurement Conditions: The above sample dispersion is added to 100 ml of the above electrolytic solution to adjust to a concentration at which particle sizes of 30,000 toner particles can be measured in 20 seconds, and thereafter the 30,000 particles are measured, and a volume-median particle size ($D_{50}$) is obtained from the particle size distribution.

[Number-Average Particle Size of External Additive]

Number-Average Particle Size (nm)=6/(ρ×Specific Surface Area ($m^2/g$))×1000 wherein ρ is a specific gravity of an external additive (for example, the specific gravity of silica is 2.2); and Specific Surface Area is a BET specific surface area obtained by nitrogen adsorption method of a raw powder before containing a metal or a metal oxide in the case of a silica containing a metal or a metal oxide, or a raw powder before the hydrophobic treatment in the case of an external additive which has been subjected to hydrophobic treatment.

Incidentally, the above formula is obtained from:

$$\text{BET Specific Surface Area}=S\times(1/m)$$

wherein m(Mass of A Particle)=$4/3\times\pi\times(R/2)^3\times$Density, and $$S(\text{Surface Area})=4\pi(R/2)^2,$$

supposing that a sphere has a particle size R.

Production Example 1 for Resins [Resins A and C]

A 5-liter four-neck flask equipped with a nitrogen inlet tube, a dehydration tube, a stirrer, and a thermocouple were charged with raw material monomers listed in Table 1 and 19.5 g of an esterification catalyst (dibutyltin oxide), and the components were heated to 230° C. and allowed to react until a reaction percentage reached 90%. Further, the reaction mixture was allowed to react at 8.3 kPa for 1 hour, to provide each of resins A and C. Here, the reaction percentage as used in the present invention is a value obtained by the formula of [amount of reaction water (mol)/theoretical amount of generated water (mol)]×100.

Production Example 2 for Resin [Resin B]

A 5-liter four-neck flask equipped with a nitrogen inlet tube, a dehydration tube, a stirrer, and a thermocouple were charged with raw material monomers listed in Table 1, 19.5 g of an esterification catalyst (dibutyltin oxide), and 2 g of a polymerization inhibitor (hydroquinone), and the components were heated to 230° C. and allowed to react until a reaction percentage reached 90%. Further, the reaction mixture was allowed to react at 8.3 kPa for 1 hour, to provide a resin B.

TABLE 1

| | Resin A | Resin B | Resin C |
|---|---|---|---|
| BPA-PO[1)] | 980 g (35) | 2688 g (96) | 980 g (35) |
| BPA-EO[2)] | 1690 g (65) | — | 1690 g (65) |
| Fumaric Acid | — | 929 g (100) | — |
| Isophthalic Acid | 1223 g (92) | — | — |
| Terephthalic Acid | — | — | 1223 g (92) |
| Softening Point (° C.) | 109.5 | 101.2 | 111.2 |
| Glass Transition Temperature (° C.) | 63.5 | 61.1 | 65.5 |
| Acid Value (mgKOH/g) | 3.9 | 19.5 | 4.8 |

Note)
The numerical values inside the parentheses are expressed by molar ratio.
[1)]Propylene oxide adduct of bisphenol A (2.2 mol).
[2)]Ethylene oxide adduct of bisphenol A (2.2 mol).

Production Example of Metal-Containing Silica

Metal-containing silicas A to C were produced in the following manner in accordance with the methods Examples 1 to 7 of JP-A-2003-104712.

Hexamethyldisiloxane as a siloxane and tetraisopropoxytitanium (colorless liquid) as an organometallic compound were mixed in a weight ratio shown in Table 2, to prepare a raw material solution. This raw material solution was fed at room temperature to a burner provided at top of a vertical combustion furnace, sprayed in the form of fine droplets with nitrogen as a spraying medium from the spraying nozzle attached to a tip end of the burner, and allowed to be combusted with the auxiliary flame according to propane combustion. Oxygen and the air were fed from the burner as oxidizing gases. The mixed composition of the siloxane and the organometallic compound, and the feeding rates of the raw material solution, propane, oxygen, the air and the sprayed nitrogen are shown in Table 2. The formed spherical powder of the complex oxide containing silica was collected with a jet classifier and a bag filter, to provide metal-containing silicas A to C.

TABLE 2

| | Metal-Containing Silica | | |
|---|---|---|---|
| | A | B | C |
| Blending Ratio of Raw Materials (Weight Ratio) | | | |
| Hexamethyldisiloxane | 95 | 88 | 95 |
| Tetraisopropoxytitanium | 5 | 12 | 5 |
| Feeding Rate | | | |
| Raw Material Solution (kg/hr) | 7.0 | 6.0 | 6.5 |
| Propane ($Nm^3$/hr) | 0.15 | 0.20 | 0.15 |
| Oxygen ($Nm^3$/hr) | 20.0 | 15.0 | 20.0 |
| Air ($Nm^3$/hr) | 10.0 | 15.0 | 10.0 |
| Sprayed Nitrogen ($Nm^3$/hr) | 2.1 | 2.0 | 2.1 |
| Compositional Ratio of Product (Weight Ratio) | | | |
| Silica | 98 | 95 | 98 |
| Titanium Oxide ($TiO_2$) | 2 | 5 | 2 |
| Number-Average Particle Size of Complex Oxide Containing Silica (nm) | 300 | 300 | 70 |

Examples 1 to 8 and Comparative Examples 1 to 6

One-hundred parts by weight of a resin binder listed in Table 3, 2 parts by weight of a releasing agent "Carnauba Wax No. 1" (commercially available from S. Kato & CO., melting point 81° C.), 3 parts by weight of a charge control agent "T-77" (commercially available from Hodogaya Chemical Industries Co., Ltd.), and 6 parts by weight of a carbon black "NIPEX60" (commercially available from Evonic Degussa Japan Co., Ltd.) were added together, and the components were mixed with a Henschel mixer for 60 seconds. The resulting mixture was melt-kneaded with a twin-screw extruder, the melt-kneaded mixture was cooled, and roughly pulverized with a hammer mill to a size of 1 mm or so. The resulting roughly pulverized product was finely pulverized with an air-jet pulverizer, and the finely pulverized product was classified, to provide toner matrix particles having a volume-median particle size ($D_{50}$) of 8.5 μm.

One-hundred parts by weight of the resulting toner matrix particles, and an external additive listed in Table 3 were mixed with a Henschel mixer for 3 minutes, to provide a toner.

The proportion of the wrong sign toner particles (positively charged toners) in the toner obtained was determined by the method described below. The results are shown in Table 3.

[Proportion of Wrong Sign Toner Particles]

The distribution of triboelectric charges in the toner particles is determined with an apparatus for determining distribution of triboelectric charges "q-test" (commercially available from Epping GmbH). The proportion (% by volume) of positively charged toner particles is calculated.

Test Example 1

Transfer Efficiency

Six parts by weight of a toner and 94 parts by weight of a ferrite carrier ("KK01-C35" (commercially available from Océ Printing Systems GmbH, volume-average particle size: 60 μm, saturation magnetization: 68 $Am^2$/kg) were mixed together, to provide a two-component developer. The resulting two-component developer was loaded on an apparatus for forming fixed images according to a non-contact developing method and a non-contact fusing method "Vario stream 9000" (commercially available from Océ Printing Systems GmbH), and a durability printing test was conducted at a print coverage of 9%, a linear speed of 1,000 mm/sec for 2 hours. Thereafter, a durability printing test was conducted at a print coverage of 0.15% for 3 hours, the printer was hard-stopped, and the amount of the toner on a photoconductor (To) and the amount of the toner on paper (Tp) were weighed. Defining a value calculated by the formula of Tp/To×100 as the transfer efficiency, the transferability was evaluated. The higher the transfer efficiency, the more excellent the transferability. The results are shown in Table 3.

Test Example 2

Image Density

Also, image samples obtained immediately before the hard stop in Test Example 1 were collected, and the image densities were measured with a colorimeter "GretagMacbeth Spectroeye" (commercially available from GretagMacbeth CO.) at 5 points of the printed portion of the fixed images, and an average was calculated as an image density (ID) to evaluate image densities. The results are shown in Table 3.

Test Example 3

Durability

A two-component developer obtained in the same manner as in Test Example 1 was loaded on an apparatus for forming fixed images according to a non-contact developing method and a non-contact fusing method "Vario stream 9000" (commercially available from Océ Printing Systems GmbH), and a durability printing test was conducted at a print coverage of 9%, a linear speed of 1,000 mm/sec for 30 hours. Thereafter, the amount of toner scumming on the carrier was measured in accordance with the following method, and durability was evaluated. The smaller the amount of toner scumming on the carrier, the more excellent the durability. The results are shown in Table 3.

(1) A two-component developer is allowed to pass through a mesh having a sieve opening of 20 μm with a vacuum cleaner, and the amount of total organic carbon of the remaining carrier is measured with a total organic carbon analyzer (Carbon Analyzer: commercially available from HORIBA, Ltd.)

(2) The carrier of which amount of total organic carbon is measured in (1) is washed with chloroform, to remove toners adhered to the carrier. After cleaning, the amount of total organic carbon of the carrier is measured.

(3) A value obtained by subtracting the amount of total organic carbon measured in (2) from the amount of total organic carbon measured in (1) is defined as the amount of toner scumming on the carrier. The amount of toner scumming on the carrier is expressed in % by weight to the carrier.

TABLE 3

| | Raw Materials for Toner | | | | | Evaluation of Toner | | | |
|---|---|---|---|---|---|---|---|---|---|
| | Resin Binder | | | | | Proportion of Wrong Sign Toner (% by volume) | Transfer Efficiency (%) | Image Density | Durability [Amount of Toner Scumming on Carrier (% by weight)] |
| | Resin A | Resin B | Resin C | External Additive* (Amount Used) | | | | | |
| Ex. 1 | 70 | 30 | — | Metal-Containing Silica A (0.3) | R972 (1.0) | 2.4 | 85 | 1.9 | 0.09 |
| Ex. 2 | 50 | 50 | — | Metal-Containing Silica A (0.3) | R972 (1.0) | 2.7 | 86 | 1.8 | 0.12 |
| Ex. 3 | 90 | 10 | — | Metal-Containing Silica A (0.3) | R972 (1.0) | 2.6 | 83 | 1.9 | 0.08 |
| Ex. 4 | 70 | 30 | — | Metal-Containing Silica A (0.5) | R972 (1.0) | 3.1 | 83 | 1.8 | 0.10 |
| Ex. 5 | 70 | 30 | — | Metal-Containing Silica A (0.7) | R972 (1.0) | 3.2 | 78 | 1.8 | 0.09 |
| Ex. 6 | 70 | 30 | — | Metal-Containing Silica B (0.3) | R972 (1.0) | 3.5 | 79 | 1.8 | 0.11 |
| Ex. 7 | 70 | 30 | — | Metal-Containing Silica C (0.3) | R972 (1.0) | 3.4 | 85 | 1.8 | 0.10 |
| Ex. 8 | 100 | — | — | Metal-Containing Silica A (0.3) | R972 (1.0) | 3.3 | 82 | 1.8 | 0.05 |
| Comp. Ex. 1 | 70 | 30 | — | NAX-50 (0.3) | R972 (1.0) | 8.4 | 65 | 1.5 | 0.10 |
| Comp. Ex. 2 | 70 | 30 | — | UFP-30HH (0.3) | R972 (1.0) | 9.5 | 69 | 1.6 | 0.14 |
| Comp. Ex. 3 | 70 | 30 | — | SFP-20M (0.3) | R972 (1.0) | 12.1 | 67 | 1.5 | 0.09 |
| Comp. Ex. 4 | — | 30 | 70 | Metal-containing Silica A (0.3) | R972 (1.0) | 7.6 | 82 | 1.8 | 0.20 |
| Comp. Ex. 5 | — | 100 | — | Metal-containing Silica A (0.3) | R972 (1.0) | 7.5 | 83 | 1.8 | 0.25 |
| Comp. Ex. 6 | — | — | 100 | Metal-containing Silica A (0.3) | R972 (1.0) | 5.5 | 48 | 1.1 | 0.22 |

Note)

The amount of Resin Binder used is expressed in parts by weight, and the amount of External Additive used is expressed in parts by weight, based on 100 parts by weight of the toner matrix particles.

*NAX-50: A hydrophobic silica commercially available from Nippon Aerosil, agent for hydrophobic treatment: HMDS, number-average particle size: 30 nm, UFP-30HH: A hydrophobic silica commercially available from Denki Kagaku Kogyo K.K., agent for hydrophobic treatment: HMDS, number-average particle size: 120 nm SFP-20M: A hydrophobic silica commercially available from Denki Kagaku Kogyo K.K., agent for hydrophobic treatment: HMDS, number-average particle size: 400 nm R972: A hydrophobic silica commercially available from Nippon Aerosil, agent for hydrophobic treatment: DMDS, number-average particle size: 16 nm It can be seen from the above results that the toners of Examples 1 to 8 can maintain excellent triboelectric chargeability and durability after the durability printing test, so that fixed images of high quality can be obtained with good transfer efficiency. By contrast, it can be seen that the toners of Comparative Examples 1 to 3 in which a silica containing a metal or metal oxide is not used show a marked increase in an amount of the wrong sign toner due to the lowering of uniformness in the triboelectric charges among the toners, and that the toners of Comparative Examples 4 to 6 without containing an isophthalic acid compound show a marked lowering in triboelectric charges. In particular, it is evident from the results of Comparative Example 6 that a toner containing a polyester containing a terephthalic acid compound, which is the same phthalic acid compound as in isophthalic acid, shows a further marked lowering in transfer efficiency and image density so that the desired effects cannot be obtained.

The toner for electrostatic image development of the present invention is suitably used in developing latent images formed in, for example, electrophotography, an electrostatic recording method, an electrostatic printing method, or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for electrostatic image development comprising (a) a toner matrix particle comprising a resin binder, and (b) an external additive added to the toner matrix particle, wherein the resin binder comprises a polyester A obtained by polycondensing an alcohol component and a carboxylic acid component comprising at least one of isophthalic acid and an ester thereof, and wherein the external additive comprises (1) fine particles comprising a complex oxide of silica and a metal or a metal oxide other than silica, and (2) a silica containing no metal or metal oxide and having a number-average particle size smaller than that of (1).

2. The toner according to claim 1, wherein the fine particles have a number-average particle size of from 100 to 1000 nm.

3. The toner according to claim 1, wherein at least one of the isophthalic acid and the ester thereof in the polyester A is present in an amount of from 50 to 100% by mol of the carboxylic acid component.

4. The toner according to claim 1, wherein the resin binder further comprises a polyester B obtained by polycondensing a carboxylic acid component comprising one or more members selected from the group consisting of fumaric acid, maleic acid, maleic anhydride, and esters thereof, and an alcohol component, and wherein the polyester A and the polyester B are present in a weight ratio, polyester A/polyester B, of from 50/50 to 90/10.

5. A method of forming fixed images comprising applying the toner as defined in claim 1 to an image-forming apparatus according to a non-contact fusing method.

6. The toner according to claim 1, wherein the metal or metal oxide is selected from the group consisting of titanium, aluminum, tin and oxides thereof.

7. The toner according to claim 1, wherein metal or metal oxide is titanium oxide.

8. The toner according to claim 1, wherein the complex oxide is obtained by spray combustion of raw materials comprising a siloxane and an organometallic compound containing one or more of said metals.

9. The toner according to claim 8, wherein the siloxane is selected from the group consisting of:

a linear organopolysiloxane without containing any halogens, represented by the formula (II):

$$(R^1)_3SiO[SiR^2R^{30}]_mSi(R^4)_3 \quad \text{(II)}$$

wherein each of $R^1$, $R^2$, $R^3$ and $R^4$, which may be identical to or different from each other, is a monovalent hydrocarbon group, an alkoxy group or a hydrogen atom; and m is an integer of 0 or greater, a cyclic organopolysiloxane represented by the formula (III):

$$[SiR^2R^{30}] \quad \text{(III)}$$

wherein $R^2$ and $R^3$ are as defined above; and n is an integer of 3 or greater, an organopolysiloxane in a branched form, a linear form with partially branching, or a three-dimensional network form, represented by the formula (IV):

$$[SiR^6O_{3/2}]_p[SiO_2]_q[SiR^7R^8O]_r[Si(R^5)_3O_{1/2}]_s \quad \text{(IV)}$$

wherein each of $R^5$, $R^6$, $R^7$ and $R^8$, which may be identical to or different from each other, is a monovalent hydrocarbon group, an alkoxy group or a hydrogen atom; and p, q, r and s are integers of 0 or greater, and mixtures thereof.

10. The toner according to claim 8, wherein the organometallic compound is a metal alkoxide compound, a metal acylate compound, a, organometallic acid compound, a metal alkyl compound, or a metal chelate compound.

11. The toner according to claim 1, wherein the silica, and the metal or metal oxide, are present in the complex oxide in a weight ratio of from 10/90 to 99/1, respectively.

12. The toner according to claim 11, wherein the weight ratio is from 50/50 to 99/1, respectively.

13. The toner according to claim 11, wherein the weight ratio is from 80/20 to 99/1, respectively.

14. The toner according to claim 2, wherein the number-average particle size is from 150 to 700 nm.

15. The toner according to claim 2, wherein the number-average particle size is from 200 to 400 nm.

16. The toner according to claim 1, wherein the carboxylic acid component in polyester A comprises the isophthalic acid and/or an ester thereof in an amount of 70 to 100% by mol of the carboxylic acid component.

17. The toner according to claim 1, wherein the carboxylic acid component in polyester A comprises the isophthalic acid and/or an ester thereof in an amount of 90 to 100% by mol of the carboxylic acid component.

18. The toner according to claim 1, wherein the carboxylic acid component in polyester A additionally comprises fumaric acid, maleic acid, maleic anhydride, and/or an ester thereof, wherein the isophthalic acid and/or an ester thereof is present in an amount of 30 to 80% by mol of the carboxylic acid component.

19. The toner according to claim 1, wherein silica (2) has a number-average particle size of 10 to 50 nm.

20. The toner according to claim 2, wherein silica (2) has a number-average particle size of 10 to 50 nm.

* * * * *